United States Patent [19]

Vahle et al.

[11] 4,060,045

[45] Nov. 29, 1977

[54] PRESSER BAR PRESSURE REGULATING MODULE

[75] Inventors: Erwin Vahle, Stutensee; Arnold Hartig, Karlsruhe, both of Germany

[73] Assignee: The Singer Company, New York, N.Y.

[21] Appl. No.: 690,125

[22] Filed: May 26, 1976

[51] Int. Cl.[2] ..... D05B 29/02

[52] U.S. Cl. ..... 112/235

[58] Field of Search ..... 112/235, 60, 61, 236, 112/237, 238, 240

[56] References Cited

U.S. PATENT DOCUMENTS

| | | | |
|---|---|---|---|
| 3,055,326 | 9/1962 | Greulich | 112/235 |
| 3,294,047 | 12/1966 | Graham | 112/235 |
| 3,303,804 | 2/1967 | Lesort | 112/235 |
| 3,410,239 | 11/1968 | Doerner | 112/235 |
| 3,433,193 | 3/1969 | Takahashi | 112/235 |
| 3,793,969 | 2/1974 | Adams | 112/235 |

*Primary Examiner*—Werner H. Schroeder
*Assistant Examiner*—Moshe I. Cohen
*Attorney, Agent, or Firm*—E. P. Schmidt; E. L. Bell; R. E. Smith

[57] ABSTRACT

A pressure regulating module for a sewing machine, the module supporting a pressure regulating cam, and a cam follower mechanism for cooperative engagement with the cam, the cam follower mechanism having a laterally extending ear impressed with a spherical surface impinging against a platform on a plunger slidably received in a bore in a presser bar of the sewing machine, the plunger being in abutment with a compression spring also received in the bore. The spherical surface, plunger, compression spring and presser bar are in substantial alignment when the module is assembled to the sewing machine frame. The cam includes a darning position where little or no pressure is applied to the presser bar, by which assembly to the sewing machine frame may be facilitated.

2 Claims, 3 Drawing Figures

PRESSER BAR PRESSURE REGULATING MODULE

BACKGROUND OF THE INVENTION

The invention relates to a presser bar pressure control module for a sewing machine.

There are in the prior art a substantial number of devices for regulating the pressure exerted by a sewing machine presser bar on a work fabric to facilitate fabric feeding. There is, for example, the U.S. Pat. No. 3,055,326, issued on Sept. 25, 1962, which discloses a presser bar having a hollow interior supporting a compression spring against which bears a plunger having an out turned arm terminating in a finger in engagement with a pressure regulating cam rotatably supported on a bracket affixed to the sewing machine frame. In this device the force applied to the spring by the cam is offset from the spring axis, giving rise to a possibility of cocking and binding of the plunger resulting in erratic pressure. In this device also careful assembly is required to insure proper engagement of the finger on the out turned arm of the plunger with the pressure regulating cam.

In the U.S. Pat. No. 3,294,047, issued on Dec. 27, 1966, there is disclosed a device having a hollow presser bar within which is supported a compression spring against which bears a plunger. The end of a lever, pivoted on a sewing machine frame, bears on the end of the plunger, with an intermediate portion of the lever having a cam follower element in engagement with a pressure regulating cam rotatably supported by the sewing machine frame. Such an arrangement requires the separate assembly or disassembly of individual components on the sewing machine frame, a tedious process required each time access to the interior of the head end of the sewing machine is required.

In the U.S. Pat. No. 3,793,696, issued on Feb. 26, 1974, is disclosed a pressure control module supporting a pressure regulating cam operating through lever arrangements to wind up a spiral spring having one end impinging on a roller carried on a side of a block affixed to a presser bar. This arrangement, while having the desirable modular construction presents some difficulties in effecting engagement of the end of the spiral spring with the roller during assembly, and also applies the spring force offset from the presser bar axis, giving rise to side loading of the presser bar inducive to cocking and binding.

What is required is a presser bar pressure control module capable of ready and carefree disassembly and assembly, which will operate in axial alignment with a presser bar and compression spring to preclude any possibility of binding and cocking.

SUMMARY OF THE INVENTION

The above objects are achieved in a pressure regulating cam and cam follower lever arrangement that are pivotably supported on a bracket attachable to a sewing machine frame. The lever arrangement terminates in an ear impressed with spherical surface which, when the bracket is attached to the sewing machine frame, impinges on a platform on the end of a plunger bearing against a compression spring supported in the hollow interior of a presser bar. The presser bar, compression spring, plunger, platform and spherical surface of the lever are in axial alignment, one to the other, with no resulting cocking or binding of any of the components.

Assembly is most readily accommodated if the pressure regulating cam is rotated to the darning position where there is little or no force on the presser bar, thereby permitting the module to be readily inserted in position and attached to the frame.

DESCRIPTION OF THE DRAWINGS

The invention may be understood by reference to the following description and appended claims taken in conjunction with the accompanying drawings wherein:

In FIG. 1 is shown a portion of a sewing machine 10 including a bed 11 which supports a standard 12, itself supporting a bracket arm overhanging the bed and terminating in a head end 15. Supported by the head end 15 is a needle bar 18 terminating in a needle 19 and adapted to undergo endwise reciprocation, in a manner well known in the prior sewing machine art, so that the needle may cooperate with sewing instrumentalities in the bed 11 of the sewing for the formation of sewing stitches, in a manner also well known in the prior sewing machine art.

Figure 1:
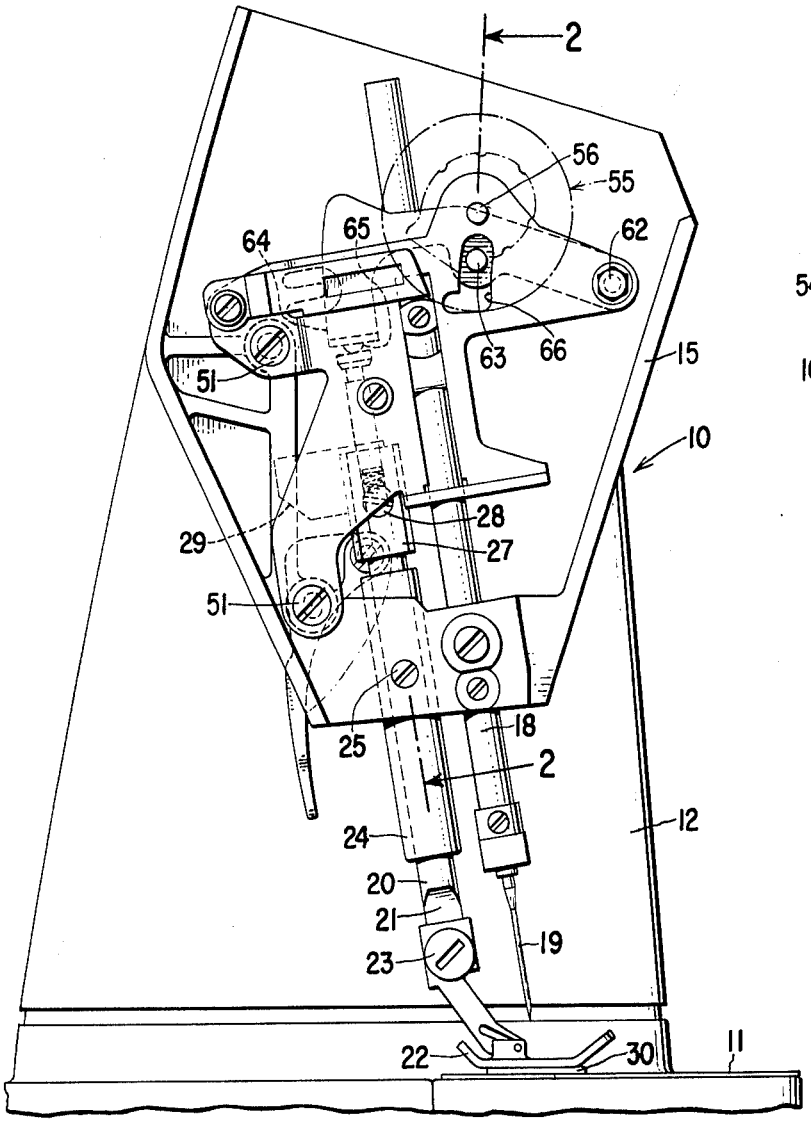
FIG. 1 is a elevational end view of a sewing machine head portion with some of the parts thereof removed to show the arrangement of pertinent parts of the invention.

Also supported in the head end 15 is a presser bar 20 terminating in a presser foot 22 affixed by screw 23 to the slabbed end 21 of the presser bar. The presser bar 20 is supported in bearing 24 affixed in the sewing machine head end 15 by screw 25. The upper end of the presser bar 20 has affixed thereto by screw 28 a guide block 27 having a fin extension 29 which protrudes through a slot in the head end 15 thereby to maintain the proper orientation of the presser foot 22 with feed dog 30 of any well known feed system which may be supported in the bed 11 of the sewing machine.

Figure 2:
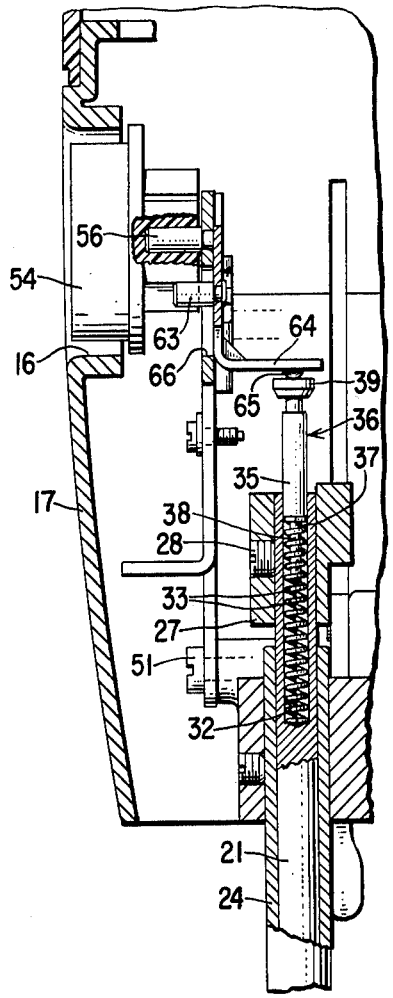
FIG. 2 is an enlarged fragmentary cross section taken substantially along line 2—2 of FIG. 1.

Referring to FIG. 2 it will be noted that the presser bar 20 is fashioned with a bore 32 beginning at the upper end of the presser bar within which is received a compression spring 33. A shiftable abutment member 36 is fashioned with a cylindrical portion 35 which is slidably accommodated within the bore 32 of the presser bar 20, and which terminates in a shoulder 37 bearing against the compression spring 33 and pin 38 which extends inside the compression spring. An enlarged right circular platform 39 is formed on the top end of the abutment member 36 perpendicular to the axis thereof. Thus the presser bar 20, compression spring 33 and the shiftable abutment member 36 are assembled on a common axis, with the platform 39 of the abutment member perpendicular to that axis.

Figure 3:
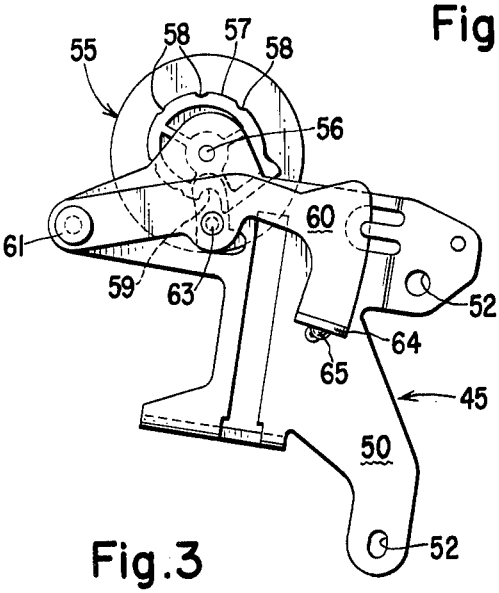
FIG. 3 is a detached elevational view of the presser bar pressure control module from the rear side thereof.

Referring to FIG. 3 there is shown a presser bar pressure control module 45 including a support bracket 50, pressure control cam 55 and presser lever 60. Referring to FIG. 1, the support bracket 50 may be attached to the head end 15 of the sewing machine 10 by screws 51 extending through holes 52 into the head end. The pressure control cam 55 is supported on pin 56 (see FIG. 2) carried by the support bracket 50. The pressure control cam 55 is formed with a spiral cam surface 57 including indents 58. A knob 54 of the pressure control cam 55 protrudes through an opening 16 in head end cover 17 to permit a change in the angular position of the cam as desired. The presser lever 60 is pivotably carried by the support bracket 50 on a shoulder of pivot screw 61 retained by nut 62. The presser lever 60 has riveted thereto a cam follower 63 (see FIG. 2) positioned on the lever so as to extend through slot 66 in the support bracket 50 and engage, in the operative state, with the spiral cam surface 57 of the pressure control cam 55. The end of the presser lever 60 opposite pivot screw 61 has an ear 64 perpendicular to the lever, and, when the support bracket 50 is attached to the head end 15 by screws 51, is perpendicular also to the common axis of the presser bar 20, compression spring 33 and abutment member 36. The ear 64 of the presser lever 60 has impressed thereon a spherical surface 65 aligned with the common axis of the presser bar 20, compression spring 33 and abutment member 36 (see FIGS. 1 & 2).

Thus it is apparent that when the support bracket 50 is attached to the head end 15 by screws 51, the spherical surface 65 on the ear 64 of the presser lever 60 impinges on the platform 39 of the abutment member 36. Rotation of the pressure control cam 55 and the spiral cam surface 57 thereof will change the position of the presser lever 60 by means of the cam follower 63, changing the compression of the compression spring 33, thereby to alter the force transmitted through the presser bar 20 to the presser foot 22. The indent 59 on the spiral cam surface 57 corresponds to the darning position wherein the presser lever 60 exerts little or no pressure on the abutment member 36. Assembly of the presser control module 45 to the sewing machine head end 15 with the cam follower 63 engaged with the darning indent 59 will facilitate attachment of the screws 51 through the holes 52 in the support bracket 50. The other indents 58 in the spiral cam surface 57 of the pressure control cam 55 provide discrete positions for presser bar pressure from light to heavy.

Having thus set forth the nature of the invention, what we seek to claim is:

1. A pressure regulating module for a sewing machine having a presser bar with an axial bore on one end and adapted to have a presser foot secured to the other and thereof, a bearing endwise shiftably supporting the presser bar in the sewing machine, a compression spring for biasing said presser bar endwise carried within said axial bore, an abutment member received in said axial bore in engagement with said compression spring and protruding from said presser bar in an enlarged right circular platform, said module comprising: a support bracket, fastenings for detachably securing said support bracket to said sewing machine in a predetermined position with respect to said presser bar, a cam shiftably supported on said support bracket, a cam follower mechanism shiftably supported on said support bracket and arranged in cooperative engagement with said cam, said cam follower mechanism having a portion thereof of spherical surface form in axial engagement with said right circular platform of said abutment member.

2. A pressure regulating module as claimed in claim 1 wherein said cam is formed with a deep indent, and said cam follower mechanism may be arranged in cooperative engagement with said deep indent to facilitate axial engagement of said sperhical surface form of said portion of said cam follower mechanism with said right circular platform of said abutment member when securing said support bracket to said sewing machine.

* * * * *